United States Patent [19]

Noble

[11] 4,022,347

[45] May 10, 1977

[54] APPARATUS FOR PUMPING AND DISPENSING LIQUID FROM PHARMACEUTICAL BOTTLES

[76] Inventor: Terrance O. Noble, 1758 Walnut Lane, Eagan, Minn. 55121

[22] Filed: Mar. 5, 1976

[21] Appl. No.: 664,262

[52] U.S. Cl. ..... 222/1; 222/400.8

[51] Int. Cl.[2] ..... B65D 83/06

[58] Field of Search ..... 222/400.8, 204, 400.7, 222/1

[56] References Cited

UNITED STATES PATENTS

| | | | |
|---|---|---|---|
| 466,336 | 1/1892 | Franklin | 222/204 |
| 661,687 | 11/1900 | Brandt | 222/400.7 |
| 858,863 | 7/1907 | Farrand | 222/400.8 |
| 1,460,209 | 6/1923 | Mohn | 222/400.8 |
| 1,665,512 | 4/1928 | Thomas | 222/400.8 |
| 1,907,763 | 5/1933 | England | 222/204 |

FOREIGN PATENTS OR APPLICATIONS

| | | | |
|---|---|---|---|
| 206,644 | 11/1923 | United Kingdom | 222/400.8 |

*Primary Examiner*—Stanley H. Tollberg
*Assistant Examiner*—Hadd S. Lane
*Attorney, Agent, or Firm*—Merchant, Gould, Smith, Edell, Welter & Schmidt

[57] ABSTRACT

Improved apparatus for dispensing a liquid from a large container having a necked upper opening, which comprises discharge and flow initiating conduits passing into the bottle through an appropriate stopper, the former including a pinchclamp and a capped dispensing nozzle, and the latter including a manual bulb air pump having appropriate check valves so that the flow from the discharge conduit, once started, may continue by siphon action or by the intermittent injection of pressure, depending on the rate of flow desired.

21 Claims, 3 Drawing Figures

APPARATUS FOR PUMPING AND DISPENSING LIQUID FROM PHARMACEUTICAL BOTTLES

BACKGROUND OF THE INVENTION

The invention is generally related to the removal or transfer of fluid from large containers, and is specifically directed to apparatus for dispensing liquid from large containers such as glass bottles. The invention is particularly suited for pharmaceutical use, assisting the pharmacist in quickly, conveniently and economically dispensing pharmaceutical liquids of a broad viscosity range in preparation of medicinal prescriptions and the like.

It is standard practice for pharmacists to dispense medicaments of a liquid nature into the patient's container from shelf bottles of one pint capacity. The dispensing may comprise pouring the fluid from the bottle into a graduate, adjusting to the proper level, then emptying the graduate into the purchaser's container; or it may involve pouring from the shelf bottle directly into the prescription container. Many liquid drugs are available for more economical purchase in one gallon bottles. It is extremely difficult, however, to dispense directly from so large a container, and a druggist wishing to achieve these economies must add the further process of repeatedly filling his shelf bottle from the larger container.

As is well known, each handling of a drug is accompanied by the danger of contamination, spillage, and glass breakage. Further, such handling consumes the pharmacists' time, and may require additional pouring vessels. It is also known that sticking of caps occurs more frequently with those bottles which are not reopened at comparatively short intervals.

SUMMARY OF THE INVENTION

The present invention avoids or minimizes the problems mentioned above by providing means for dispensing directly from a gallon container into the prescription container. It includes means to be inserted into a gallon bottle when it is first opened, by which the druggist may hereafter repeatedly draw desired quantities of liquid of various viscosities conveniently, quickly, and accurately. The inventive apparatus eliminates the frequent task of repeatedly filling pint bottles, the handling of both pint and gallon containers, and the intermediate pouring steps from gallon bottles to pint bottles to the measuring graduate. As such, the invention represents a significant saving of time to the pharmacist. Further, the invention eliminates overflow of the filled container by reason of an instantaneous shut-off feature, and avoids spilling since the outlet is constructed to fit inside the neck of the receiving container. The invention eliminates glass breakage, which occurs with repeated handling of bottles. Other important features of the invention reside in a special discharge nozzle for convenient drip-free dispensing, and a drip cover seal for the nozzle.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 3:
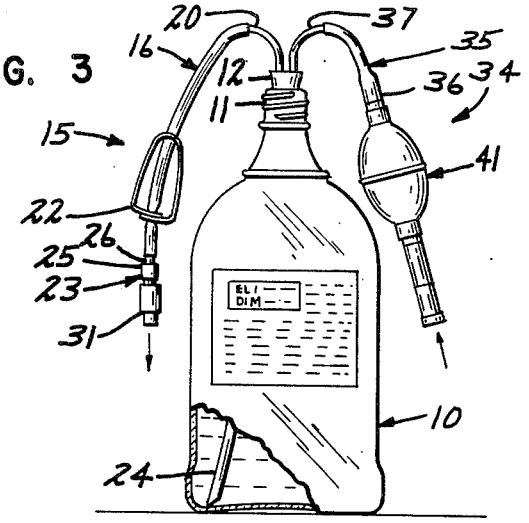
FIG. 3 shows a modification.

In the drawing, 10 is a conventional one gallon container having its upper end formed with a neck 11 for receiving a screw cap, not shown. A flexible stopper 12 is dimensioned to fit tightly into the neck of the container, and is traversed by a pair of apertures 13 and 14. For reasons described hereinbelow, stopper 12 is formed from a resilient material, and is preferably pure gum formulated with Isoprene, which equals the physical properties of natural rubber and is more resistant to temperature changes.

I provide delivery means 15 comprising a conduit 16 extending from the bottom of the container out through the stopper to terminate in an end 17 lower than the bottom of the bottle. For this purpose, a rigid angle tube 20 of glass, plastic, or other suitable material passes through aperture 13 in the stopper. A long flexible tubing or hose 21 engages the outer end of angle tube 20 and passes through a normally closed pinch-clamp 22 before terminating at a nozzle 23. Inside the bottle, conduit 16 extends, as by a flexible tube 24, to the bottom of the container, and is cut off at a bevel to prevent the terminal opening from closure by virtue of the positions of the terminal and against the inside wall of the container.

Nozzle 23 includes a manual grip portion 25, a first end 26 to receive tubing 21, and a dispensing tip 27 in the form of a convex conical surface 30. A cap 31 is provided as part of nozzle 23, and comprises a concave conical surface 32 matching surface 30, and a closed reservoir 33.

I also provide flow initiating means 34 comprising a conduit 35 extending from just below stopper 12 inside the container through the stopper to terminate at an end 36. For this purpose a second rigid angle tube 37 passes through aperture 14 in the stopper. A long flexible hose or tubing 40 engages the outer end of angle tube 37 and is connected at end 36 to an air pump 41 of the familiar manual bulb type. Pump 41 includes a pair o check valves 42 and 43, for preventing air flow except toward the bottle. A filter 44 of micronite or other suitable material is provided at the input end of pump 41. A flutter valve 45 is installed on tube 37 inside the bottle adjacent the stopper to prevent backflow pressure to the squeeze bulb 41, thus insuring that pressure is maintained within the container 10.

Figure 2:
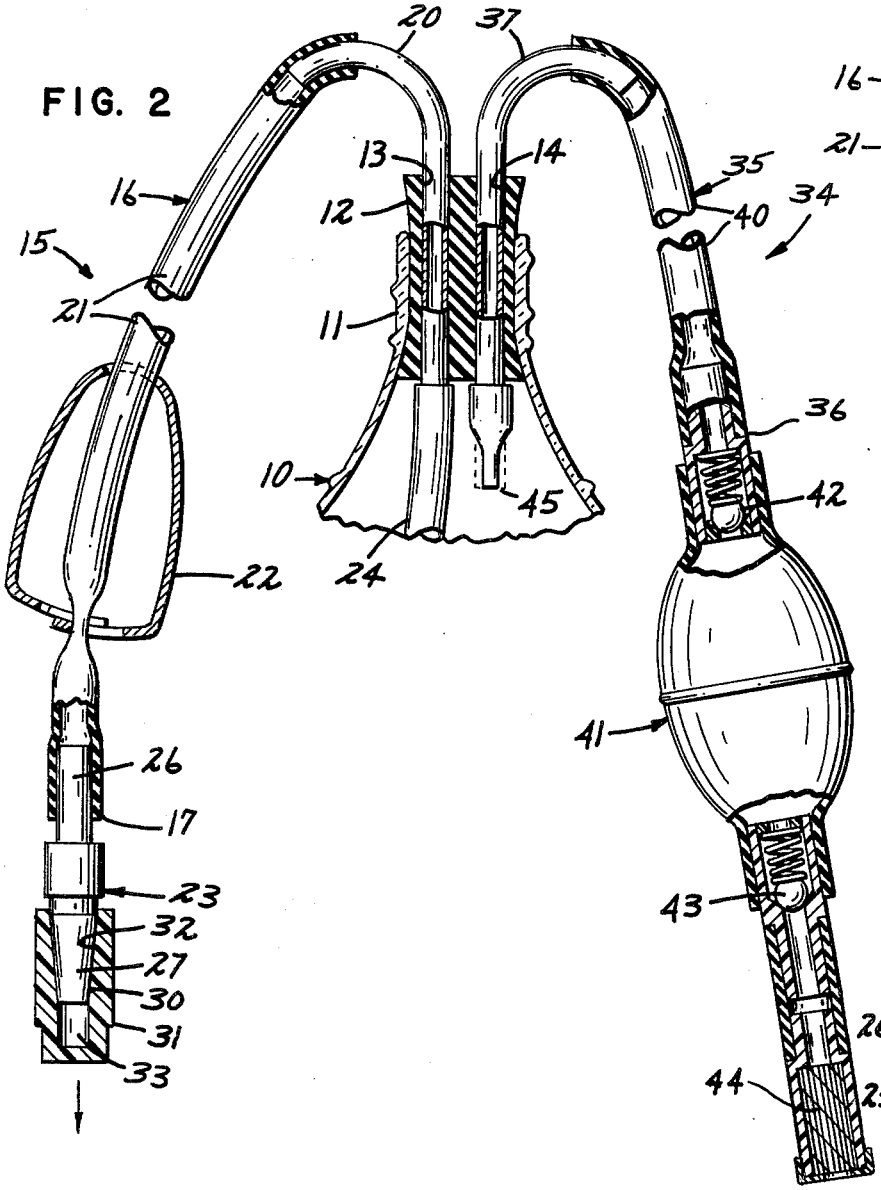
FIG. 2 is an enlarged view in elevation of a portion of my invention, parts being broken away and shown in section.

In use, a gallon bottle of the liquid to be dispensed is uncapped and stopper 12 is inserted securely in the neck. As shown in FIG. 2, the stopper 12 is inserted into the neck 11 a sufficient distance to permit expansion of the lower end of the stopper to enhance its staying capability. Because of the type of material used for stopper 12, it is capable of maintaining a tight seal in spite of the pressure within the container 10 with the qualification below noted. Preferably, the stopper 12 is moistened along its lower edge with water or glycerin to ease its entry into the neck 11 of the container 10. The stopper 12 is pushed down and twisted until the terminal end of tube 24 comes to rest at the bottom surface of container 10.

The bottle is next placed at a suitable elevated location with tubings 21 and 40 depending to a convenient point: if desired, support for these tubings may be provided in the form of an adhesive tape 46 securing them to container 10. Next, the bulb 41 is squeezed two to three times, which provides sufficient pressure to the full container 10. The air entering container 10 is, of course, filtered by reason of the presence of micronite filter 44. After the cap 31 has been removed, the pinchclamp 22 is slowly opened to avoid the spattering of liquid entering the prescription container.

Figure 1:
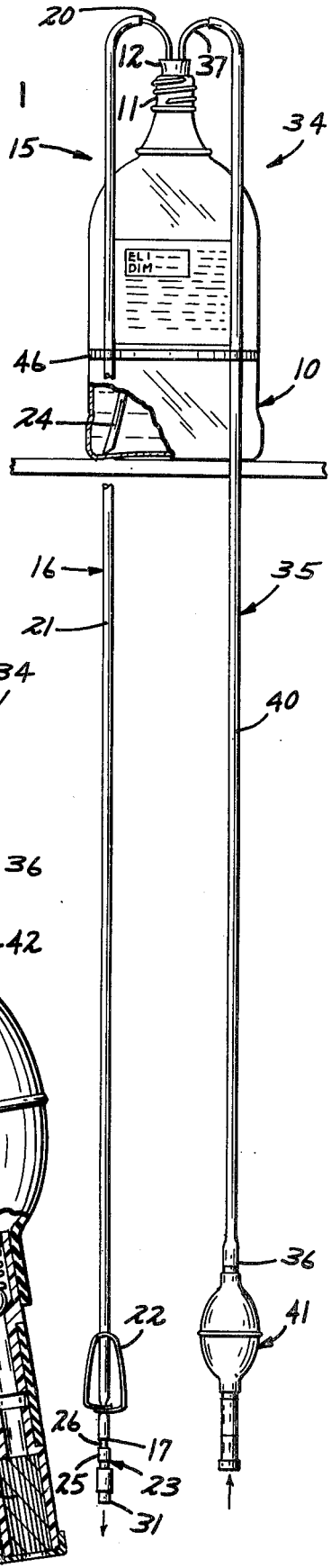
FIG. 1 is a general view of my invention in use.

With reference to the embodiment of FIG. 1, as soon as the level of the liquid in conduit 15 descends below the bottom of bottle 10, no further pumping is necessary, as flow continues by siphon action. When liquid appears at nozzle 23, pinchclamp 22 is allowed to close, which quickly terminates the flow of liquid. When the liquid is needed, it is only necessary to remove cap 31, place tip 27 within the graduate or other container to be filled, and release pinchclamp 22 sufficiently to allow liquid flow. When sufficient liquid has been drawn, pinchclamp 22 is allowed to close tubing 21 again, the final drop of liquid is removed from tip 27 by contact, and cap 31 is replaced.

The modified embodiment of FIG. 3 includes tubing 21 and 40 of significantly lesser length, which is used when the apparatus and container are disposed at a more accessible height. It will be appreciated that siphoning action is not possible with this embodiment, and it is therefore necessary to periodically increase the pressure level in container 10 through operation of the squeeze bulb 41 as described above. In this regard, it is noted that gallon containers normally used for pharmaceutical liquids are manufactured from glass, and preferably do not contain pressure at a high level over a period of time. The material of stopper 12 is chosen with this potential problem in mind. I have found that the pure gum stopper formulated with Isoprene permits very slow leakage of air from the container so that the internal pressure ultimately equalizes with atmospheric pressure. It is believed that such leakage occurs through those areas of the stopper 12 which are directly contiguous with glass; i.e., along the inner surface of the bottle neck 11 and the outer surface of angle tubes 20 and 37. In effecting such leakage, the problem of container breakage resulting from excessive pressure over a period of time is avoided. It is then generally necessary to squeeze the bulb 41 only two or three times to bring the internal pressure to an appropriate level for satisfactory operation of the apparatus.

From the foregoing it will be evident that I have invented a new and useful dispensing arrangement which is inexpensive, convenient, reliable, and minimizes the work of the druggist in dispensing liquids by eliminating the use of a shelf bottle, the misfortune of breakage or spillage, and the irritation of sticking caps. It will be further apparent that the entire operation can be performed with one hand, thus enabling the pharmacist to carry out the task more easily and quickly.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. Apparatus for dispensing liquid from a top-opening, necked container, comprising, in combination:
   - A. generally cylindrical stopper means constructed to fit into the neck of the container with a substantial portion of the generally cylindrical outer surface of the stopper means in conforming engagement with the inner surface of the container neck;
   - B. delivery means comprising
     1. first conduit means at least a portion of which is formed from resilient material, the first conduit means passing through the stopper means and comprising
        - a. an inlet end spaced from the stopper means a sufficient distance to permit the inlet end to extend to a point proximate the bottom of the container;
        - b. an outlet end;
        - c. a dispensing nozzle connected to the outlet end for smoothly dispensing liquid from the outlet end of the first conduit means;
     2. a drip-preventing cap constructed to fit over the open end of the nozzle during periods of nonuse;
     3. normally closed means disposed on the resilient portion of the first conduit means and operable in the connection therewith for controlling the flow of liquid therethrough;
   - C. flow initiating means comprising
     1. second conduit means passing through the stopper to establish fluid communication with the inside of the container;
     2. and check valved, manually operable air pump means operably connected to the second conduit means for affording a one-way flow of air through the second conduit means and for building air pressure within the container;
   - D. the stopper means being constructed to permit the slow leakage of pressure from the container and to preclude pressure within the container from being sustained for excessive periods of time.

2. The apparatus defined by claim 1, wherein the normally closed means comprises a manually operable pinchclamp movable from a normally closed position clamping the first conduit means to obstruct fluid flow to a release position permitting the flow of liquid through the first conduit means.

3. The apparatus defined by claim 2, wherein the second conduit means includes an outlet end terminating in a flutter check valve.

4. The apparatus defined by claim 1, wherein the extreme inlet end of the first conduit means is doubled to permit direct contact with the container bottom without obstructing fluid flow.

5. The apparatus defined by claim 1, wherein the first conduit means comprises
   - a. a rigid tube passing through the stopper means;
   - b. a first resilient tube connected to the rigid tube and defining the inlet end;
   - c. and a second resilient tube defining said resilient portion.

6. The apparatus defined by claim 5, wherein the rigid tube is glass.

7. The apparatus defined by claim 4, wherein the second conduit means comprises:

a. a rigid passing through the stopper means, one end of which defines said inlet end;
b. and a resilient tube connected to the opposite end of the rigid tube.

8. The apparatus defined by claim 4, and further comprising replaceable filter means disposed in the second conduit means upstream of the air pump means.

9. The apparatus defined by claim 4, wherein the distance between the outlet end of the first conduit means and the stopper means is greater than the height of the container to be used, whereby flow, once initiated, may be continued by siphon action.

10. Dispensing apparatus for liquid, comprising, in combination:

A. a top opening, necked container;
B. generally cylindrical stopper means constructed to fit into the neck of the container with a substantial portion of the generally cylindrical outer surface of the stopper means in conforming engagement with the inner surface of the container neck;
C. delivery means comprising
1. first conduit means at least a portion of which is formed from resilient material, the first conduit means passing through the stopper means and comprising
a. an inlet end spaced from the stopper means a sufficient distance to permit the inlet end to extend to a point proximate the bottom of the container;
b. an outlet end;
c. a dispensing nozzle connected to the outlet end for smoothly dispensing liquid from the outlet end of the first conduit means;
2. a drip-preventing cap constructed to fit over the open end of the nozzle during periods of nonuse;
3. normally closed means disposed on the resilient portion of the first conduit means and operable in connection therewith for controlling the flow of liquid therethrough;
D. flow initiating means comprising
1. second conduit means passing through the stopper to establish fluid communication with the inside of the container;
2. and check valved, manually operable air pump means operably connected to the second conduit means for affording a one-way flow of air through the second conduit means and for building air pressure within the container;
E. the stopper means being constructed to permit the slow leakage of pressure from the container and to preclude pressure within the container from being sustained for excessive periods of time.

11. The apparatus defined by claim 10, wherein the normally closed means comprises a manually operable pinchclamp movable from a normally closed position clamping the first conduit means to obstruct fluid flow to a release position permitting the flow of liquid through the first conduit means.

12. The structure of claim 11 in which said nozzle comprises a manual grip portion and a dispensing tip having a convexly conical outer surface, and said cap has a concavely conical surface matching the surface of said tip and a reservoir at the restricted end of said surface.

13. The apparatus defined by claim 10, wherein the second conduit means includes an outlet end terminating in a flutter check valve.

14. The apparatus defined by claim 10, wherein the extreme inlet end of the first conduit means is doubled to permit direct contact with the container bottom without obstructing fluid flow.

15. The apparatus defined by claim 10, wherein the first conduit means comprises
a. a rigid tube passing through the stopper means;
b. a first resilient tube connected to the rigid tube and defining the inlet end;
c. and a second resilient tube defining said resilient portion.

16. The apparatus defined by claim 15, wherein the rigid tube is glass.

17. The apparatus defined by claim 14, wherein the second conduit means comprises:
a. a rigid tube passing through the stopper means, one end of which defines said inlet end;
b. and a resilient tube connected to the opposite end of the rigid tube.

18. The apparatus defined by claim 14, and further comprising replaceable filter means disposed in the second conduit means upstream of the air pump means.

19. The apparatus defined by claim 14, wherein the distance between the outlet end of the first conduit means and the stopper means is greater than the height of the container to be used, whereby flow, once initiated, may be continued by siphon action.

20. The method of dispensing liquid from a top-opening, necked container, comprising the steps of:
a. placing a generally cylindrical stopper into the open neck of the container with a substantial portion of the generally cylindrical outer surface of the stopper in conforming engagement with the inner surface of the container neck;
b. supplying compressed air through a first tube extending through said stopper to the surface of the liquid in the container to force the liquid out of the container through a second tube extending from a point proximate the bottom of the container through the stopper to a point outside the container;
c. and allowing pressure within the container to slowly diminish by the leakage of air therefrom to preclude said pressure form being sustained therein for excessive periods of time.

21. The method of claim 20 which includes the further step of controlling the passage of fluid from the container by preventing its egress from said second tube.

* * * * *

UNITED STATES PATENT AND TRADEMARK OFFICE

CERTIFICATE OF CORRECTION

PATENT NO. : 4,022,347
DATED : May 10, 1977
INVENTOR(S) : Terrance O. Noble

It is certified that error appears in the above-identified patent and that said Letters Patent are hereby corrected as shown below:

Column 2, line 50, "o" should be --of--.

Column 5, line 1, after the word "rigid" insert --tube--.

Column 6, line 53, the word "form" should be changed to the word --from--.

Signed and Sealed this twenty-sixth Day of July 1977

[SEAL]

*Attest:*

RUTH C. MASON
*Attesting Officer*

C. MARSHALL DANN
*Commissioner of Patents and Trademarks*